United States Patent [19]

Lipschutz

[11] 4,277,962

[45] Jul. 14, 1981

[54] DEVICE FOR BLOCKING KEY PASSAGE OF A LOCK

[75] Inventor: Paul Lipschutz, Croissy, France

[73] Assignee: Neiman SA, France

[21] Appl. No.: 39,981

[22] Filed: May 17, 1979

[30] Foreign Application Priority Data

Jun. 6, 1978 [FR] France ..... 78 17100

[51] Int. Cl.[3] ..... E05B 17/14

[52] U.S. Cl. ..... 70/423; 70/431

[58] Field of Search ..... 70/423, 419, 416, 421, 70/420, 431, 447

[56] References Cited

U.S. PATENT DOCUMENTS 3,820,364 6/1974 Greeley ..... 70/419

FOREIGN PATENT DOCUMENTS 103466 1/1926 Austria ..... 70/423

*Primary Examiner*—Robert L. Wolfe

*Attorney, Agent, or Firm*—James Creighton Wray

[57] ABSTRACT

The invention relates to a device for blocking the key passage of a lock. The device can be utilized as a supplemental security, permitting the use of the lock only after a specific condition has been satisfied to produce the retraction or moving aside of the blocking element. The device comprises a movable abutment which can occupy a first position in which it blocks the key passage and a second position in which it clears the passage, the movement from the first position to the second position being controlled by a thermo-deformable element.

4 Claims, 5 Drawing Figures

1
2
3
4
5
6
7
8
9
10
11
12
13
14
+

DEVICE FOR BLOCKING KEY PASSAGE OF A LOCK

BACKGROUND TO THE INVENTION

The invention relates to a device for blocking the key passage of a lock.

OBJECT OF THE INVENTION

The device according to the invention can be utilised as supplementary security, permitting the use of the lock only after a specific condition has been satisfied which produces the moving aside of the device.

SUMMARY OF THE INVENTION

According therefore to the present invention, a device is provided for blocking the key passage of a lock, the device comprising a movable abutment which can occupy a first position in which it blocks the key passage and a second position in which it clears the said passage, and a thermo-deformable element for moving said abutment from the first position to the second position when activated.

In a first form of embodiment the said abutment is connected to a pivoting lever, the said lever being fixed to the end of an expansible conductor wire connected to a current source through the intermediary of a switch. The said lever preferably comprises an abutment cooperating with a flexible blade for placing the said wire in contact with the said source.

In a second form of embodiment the said abutment is connected to a thermo-deformable element and the said electric means comprise a resistor for heating the said element.

BRIEF DESCRIPTION OF DRAWINGS

The invention will be clearly understood on reading of the following description given with reference to the accompanying drawings, wherein.

DESCRIPTION OF PREFERRED EMBODIMENTS

Figures 1, 2, 3, 4, 5:
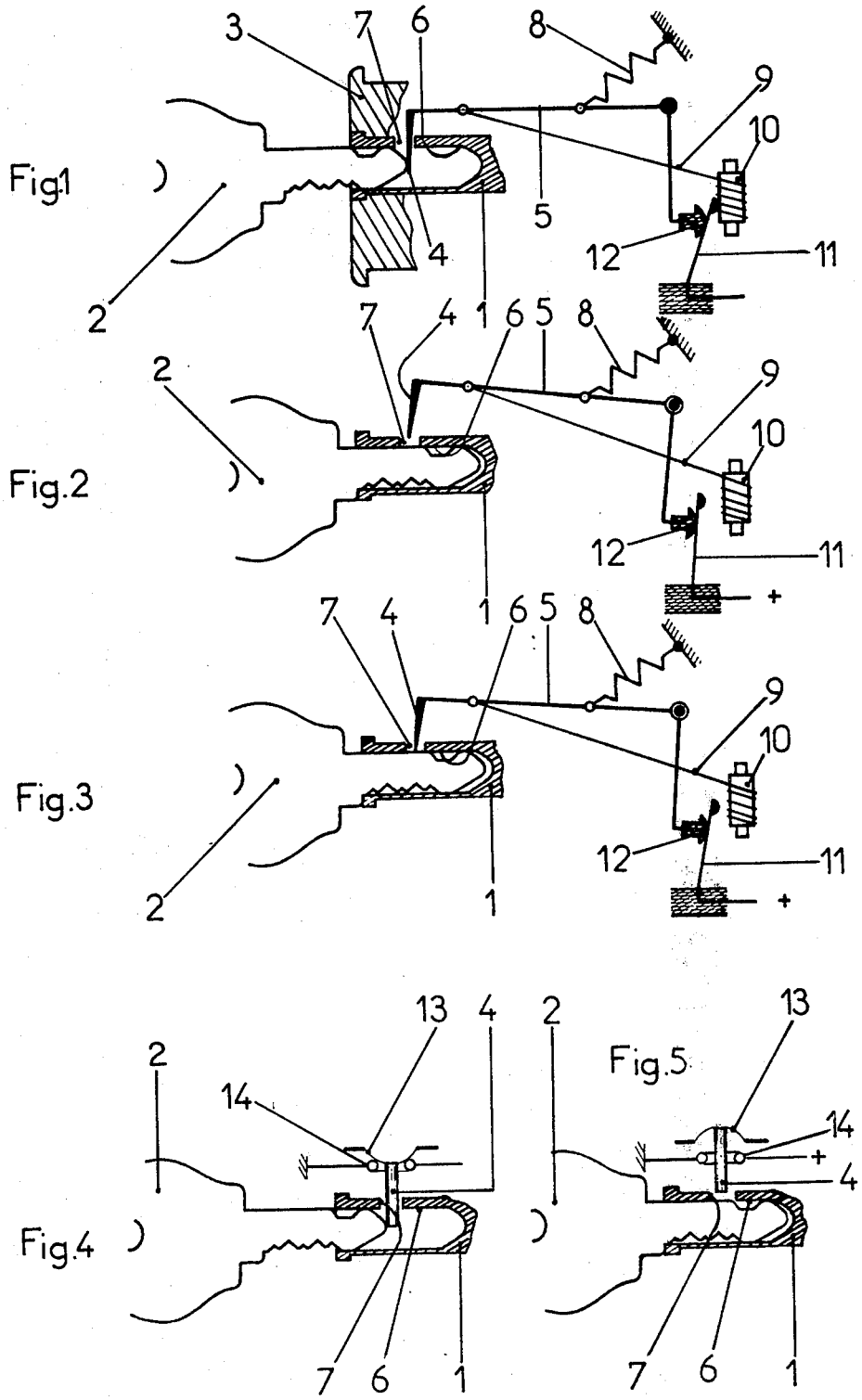
FIG. 1 is a diagram of the first form of embodiment of the device according to the invention, in the blocking position.
FIG. 2 is analogous with FIG. 1, in the position in which the key passage is cleared.
FIG. 3 is analogous with FIGS. 1 and 2, the shutter being in abutment against the key.
FIG. 4 is a diagram of the second form of embodiment of the device according to the invention, in the blocking position.
FIG. 5 is analogous with FIG. 4, but in the cleared position.

Reference will be made firstly to FIGS. 1 to 3. The lock comprises a cylinder 1 controlled by a key 2 and pivoting in a body 3. An abutment 4 fixed to the extremity of a conductive lever 5 penetrates into the key passage 6 of the cylinder 1 through a slot 7. The lever 5 is subject to the action of a spring 8 which is earthed and tends to remove the abutment 4 from the passage 6. An expansible conductive wire 9 is fixed at one end to the lever 5 and is wound on a coil 10. A flexible conductive blade 11 connected to the positive terminal of an electric supply source through the intermediary of a switch (not shown) is pressed against the coil 10 by an insulating stud 12 of the lever 5.

The arrangement is such that when the wire 9 is retracted in the absence of supply through the blade 11, the lever is pivoted against the action of the spring 8, pushing the abutment 4 into the slot 7 (FIG. 1). If the contact 11 is fed, the wire 9 expands and under the action of the spring 8 the lever 5 pivots, bringing the abutment 4 out of the slot 7 (FIG. 2). As this takes place, the stud 12 liberates the flexible blade 11 which departs from the coil 10, cutting off the supply of the wire 9, even if the contact 11 remains supplied. In cooling, the wire 9 tends to pivot the lever 5 and the abutment 4 comes into contact with the key 2 (FIG. 3). After the key is withdrawn the abutment 4 can penetrate completely into the slot 7 in order to return to the position according to FIG. 1.

Reference will now be made to FIGS. 4 and 5, in which the same references designate the same elements as in FIGS. 1 to 3. The abutment 4 is fast with a thermo-deformable element 13 subject to the action of a resistor 14. When the resistor is not supplied, the abutment 4 penetrates into the key passage 6 through the slot 7 and prevents the introduction of the key 2 (FIG. 4). If the resistor 14 is supplied, the element 13 is deformed, shifting the abutment 4 which clears the key passage 6 (FIG. 5).

I claim:

1. A device for blocking the key passage of a lock, comprising:

(a) a movable abutment which can occupy a first position in which it blocks the key passage and a second position in which it clears the said passage, and (b) a thermo-deformable element for moving said abutment from the first position to the second position when activated.

2. A device according to claim 1, including a pivoting lever to which said abutment is connected, said deformable element comprising an expansible conductive wire mechanically connected between said lever and a fixed position and electrically connectible to a current source whereby said wire expands to cause movement of said lever.

3. A device according to claim 2, wherein the lever comprises a further abutment cooperating with a flexible blade for placing the said wire in contact with the current source.

4. A device according to claim 1, wherein the thermo-deformable element is mechanically connected to said movable abutment, a resistor being provided for heating the element.

* * * * *